US010398246B2

(12) United States Patent
Crooks

(10) Patent No.: US 10,398,246 B2
(45) Date of Patent: Sep. 3, 2019

(54) SECURE PACKAGE RECEPTACLE CHUTE

(71) Applicant: Winston D'Arcey Crooks, Sunrise, FL (US)

(72) Inventor: Winston D'Arcey Crooks, Sunrise, FL (US)

( * ) Notice: Subject to any disclaimer, the term of this patent is extended or adjusted under 35 U.S.C. 154(b) by 0 days.

(21) Appl. No.: 15/970,802

(22) Filed: May 3, 2018

(65) Prior Publication Data

US 2018/0317687 A1 Nov. 8, 2018

Related U.S. Application Data

(60) Provisional application No. 62/500,665, filed on May 3, 2017.

(51) Int. Cl.
*A47G 29/12* (2006.01)
*A47G 29/22* (2006.01)

(52) U.S. Cl.
CPC ..... *A47G 29/12* (2013.01); *A47G 29/22* (2013.01)

(58) Field of Classification Search
CPC ..... A47G 29/12; A47G 29/22; A47G 29/14; B65G 11/04; B65G 11/12; E04F 17/12; B65F 1/0093; B65F 1/0013; B65F 1/1431; F23G 5/444
USPC ..... 232/1 E, 19, 44, 45, 43.5; 220/479, 908; 193/8, 33, 34; 109/66
See application file for complete search history.

(56) References Cited

U.S. PATENT DOCUMENTS 443,060 A * 12/1890 Stockbridge et al. .... B65F 1/02 220/479
472,667 A * 4/1892 Fergus ..... B65F 1/02 220/479
478,702 A * 7/1892 Merritt ..... B65F 7/00 220/87.1
801,392 A * 10/1905 Meyerhofer, Jr. ..... B65F 1/02 220/479
1,488,885 A * 4/1924 Kneiple ..... B65F 1/02 220/479
1,672,199 A * 6/1928 Brown ..... E06B 5/02 193/17
1,707,011 A * 3/1929 Heybeck ..... F23G 5/444 193/34
1,733,801 A * 10/1929 Heybeck ..... F23G 5/444 193/34
1,755,089 A * 4/1930 Wyse ..... F23G 5/444 193/34
1,804,788 A * 5/1931 Kummer ..... E04F 17/12 193/34
1,880,370 A * 10/1932 Breitwieser ..... F23G 5/444 110/256
2,062,793 A * 12/1936 Erskine ..... F23G 5/444 193/34
5,492,272 A * 2/1996 Fewer ..... A47G 29/12 232/19

(Continued)

*Primary Examiner* — William L Miller
(74) *Attorney, Agent, or Firm* — Ted Whitlock

(57) ABSTRACT

A unitary package receptacle chute for disposition within a wall or door wherein the chute includes a front panel foldably connected to a floor panel at an obtuse angle. The front panel and floor panel are further connected to one another by two opposing side panels, the panels being configured to form a pivoting package repository for receiving and transferring a package from one side of the wall or door to the other side. The invention also includes a kit and method for making the inventive chute.

15 Claims, 6 Drawing Sheets

(56) References Cited

U.S. PATENT DOCUMENTS 7,240,823 B1 * 7/2007 Saidiazar ..... A47G 29/12
232/19
7,641,103 B1 * 1/2010 Tomich ..... E06B 3/38
220/479

* cited by examiner

SECURE PACKAGE RECEPTACLE CHUTE

FIELD OF INVENTION

The invention relates to a device which will allow for the secure delivery and receipt of a package or document sent and delivered through a package delivery or courier service wherein the delivered package or document remains secure and inaccessible until retrieved by the intended recipient of the package or document.

BACKGROUND OF INVENTION

With the convenience of online shopping comes a growing problem of package theft, wherein packages delivered and dropped at an unsecure location, e.g., outside a business or residence, remain accessible to a third party that is not the intended recipient of the package or document and may steal the package before the intended recipient can retrieve the package or document. In 2016, an estimated $327 billion was spent on online with 23 million consumers being victims of package theft resulting from packages purchased online being left out in plain sight on front porches after being delivered.

While there have been many recent developments that attempt to combat the growing trend in package theft, these developments tend to be either complicated, impractical or obtrusive. These include: special smart phone APPS to alert consumers when a package was delivered; cameras; APPS allowing or directing delivery persons to open receptacles; APPS allowing delivery persons to enter the home; remote drop off locations and lastly, large obtrusive drop off boxes bolted down in the front porch entrance areas, to name a few.

Accordingly, it would be advantageous to have a simple, cost effective package delivery/receipt device that can be easily accessed by the delivery person yet will keep the package secured and out of sight until the recipient retrieves the delivered items. The device would also be able to accommodate standard letters, express mail envelopes, small and medium to 'large' size packages and boxes.

SUMMARY OF THE INVENTION

The subject invention is directed to a unitary package receptacle chute for disposition within a vertical structure such as a wall or door (e.g. a garage door). The purpose of the invention is to curtail the growing epidemic of package theft from porches and entrance ways. Generally, the subject invention comprises a package receptacle chute that can be disposed within the vertical structure so as to become part of or integral with the structure. In one embodiment, the device is disposed within a garage door wherein one of the panel sections is removed and replaced with the device in order to provide a repository that may be accessed from outside the garage door by a delivery person while still protecting access to the inside of the garage.

More specifically, the receptacle chute of the present invention includes a front panel that is foldably connected to and extends from a floor panel at an obtuse angle. The front panel and floor panel are further connected to one another by two opposing side panels. The panels are configured to form a pivoting package repository for securely receiving and transferring a package from one side of a wall or door to the other side. Each side panel includes at least two independent sections. The first section is foldably connected to the front panel while the second section is foldably connected to the floor panel. Additionally, the first and the second sections are affixed to one another to render the resulting side panel substantially planar and contiguous.

In operation, the chute pivots open to receive a package or document from outside a garage door, for example. Once a parcel is placed in the chute, the front panel is pushed back toward the garage door to move the parcel to the inside of the garage whereupon it slides down the angled floor panel of the device to drop inside the garage, effectively providing secure delivery of the parcel.

When the chute has been installed and is operative to receive a parcel, the front panel and floor panel are affixed to one another at an obtuse angle. Therefore, opening the chute on the delivery side of the door causes the floor panel to be raised to a position which blocks entry to the other side of the door or wall. Once the package is delivered inside the garage, a person re-opening the front panel cannot gain access to the inside of the garage due to the blocking effect created by the raised floor panel of the chute. In one preferred embodiment, the obtuse angle will be at least greater than 90 degrees and more preferably, 100 or 120 degrees.

Additionally, the package receptacle chute of the present invention may further comprise at least one hinged attachment means for attaching the chute to the wall or door. For example, the hinged attachment means may include at least one hinge that articulates with two hinge plates. The first hinge plate is affixed to the chute at either the front panel or the floor panel while the second hinge plate is affixed to the existing wall or door. Accordingly, the chute may pivot about the hinge between an open and closed position relative to the outside environment. Moreover, the front panel of the chute may optionally include an external face plate affixed to the front panel as well as an external handle.

The receptacle chute of the present invention may optionally include a locking means disposed on the internal aspect of the chute to prevent the chute from being opened. For example, the locking means may be a horizontal locking bar that is slidably received through both side panels to prevent chute movement.

Additionally, the upper edges of the side panels may be preferably rounded so as to include a convex radial shape in order to impart the maximum height to the side panels while still affording adequate clearance for movement of the chute between an open position for receiving packages and the closed position.

Where the present invention is to be utilized with a garage door, the invention may preferably undergo fabrication by specialized garage door manufacturers or, alternatively, fabrication by a generic fabrication contractor with subsequent assembly/installation by the garage door installers, dealers or end users.

The disclosure of this design may readily be utilized as a basis for the design of other similar systems and structures to carry out the same purposes as the secure package receptacle chute of the present invention, the appended claims to which are regarded as including such similar construction or systems.

Accordingly, herein is provided various embodiments, features and advantages of the present invention that will be apparent to those of ordinary skill in the art in view of the following detailed description of the invention and accompanying drawings.

BRIEF DESCRIPTION OF THE DRAWINGS

The drawings, as provided for herein, set forth exemplary embodiments of the present invention as further discussed in the detailed description which follows herein. Accordingly, the drawings are merely illustrative and clearly not intended to limit the invention as encompassed by the appended claims.

DETAILED DESCRIPTION OF THE INVENTION

The following description is made in general reference to FIGS. 1-6 and is provided herewith solely to illustrate exemplary embodiments of the present invention.

Figure 1:
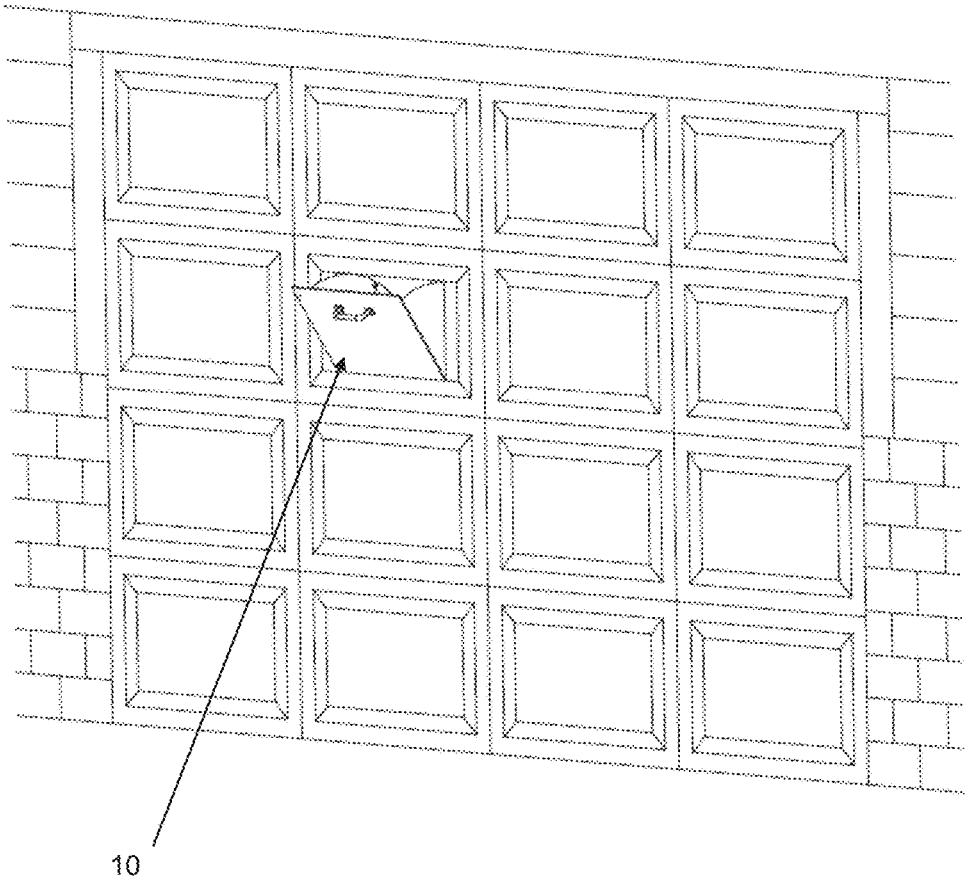
FIG. 1 is an outside frontal view of package receptacle chute disposed within a garage door.
Figure 2:
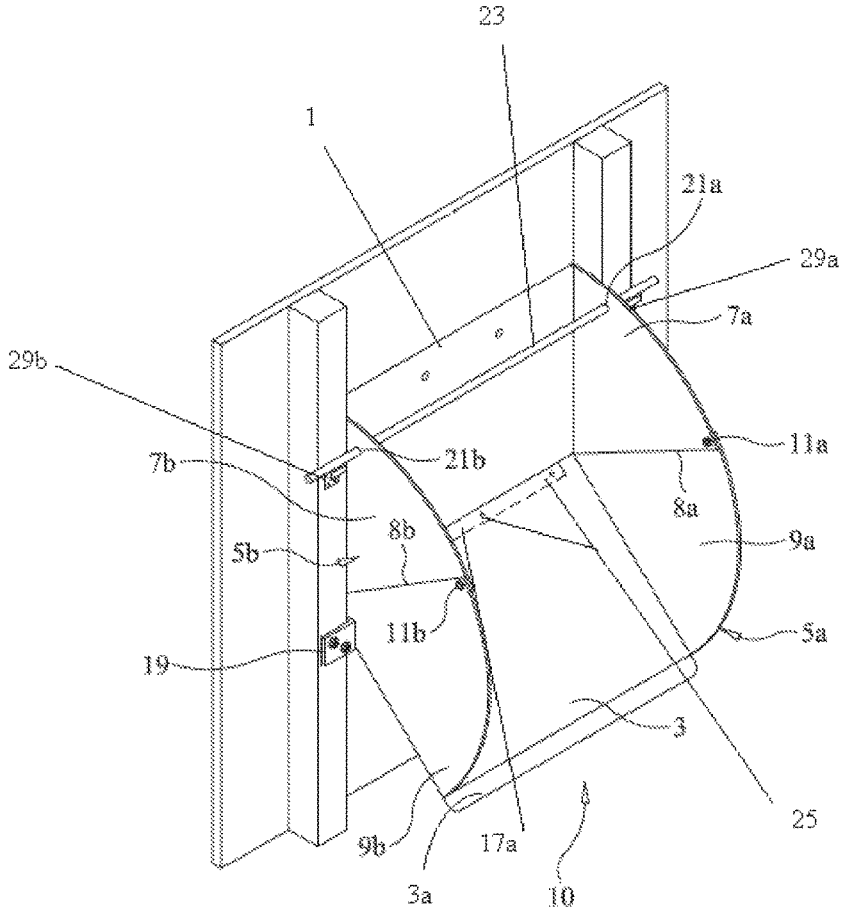
FIG. 2 is an inside elevated perspective view of the package receptacle chute in the open position relative to the package retrieval side.

Referring to FIG. 1, the invention 10 is directed to a unitary package receptacle chute for disposition within a vertical structure such as a wall or door (e.g. a garage door). Referring to FIG. 2, receptacle chute 10 can be seen to comprise front panel 1 that connects to and extends from floor panel 3 at an obtuse angle. Floor panel 3 may also include extension lip 3*a* which can serve as a positional stop for chute 10 when it is opened to receive a delivery parcel. Front panel 1 and floor panel 3 are further connected to one another by two opposing side panels 5*a* and 5*b* so as to form a pivoting package repository for receiving and transferring a package from one side of the door to the other. As discussed in more detail below, it will be appreciated that the exterior appearance of front panel 1 may be aesthetically improved by affixing to it all or part of that portion of a wall or door which has been excised to create a portal in which to mount the chute.

Figure 3:
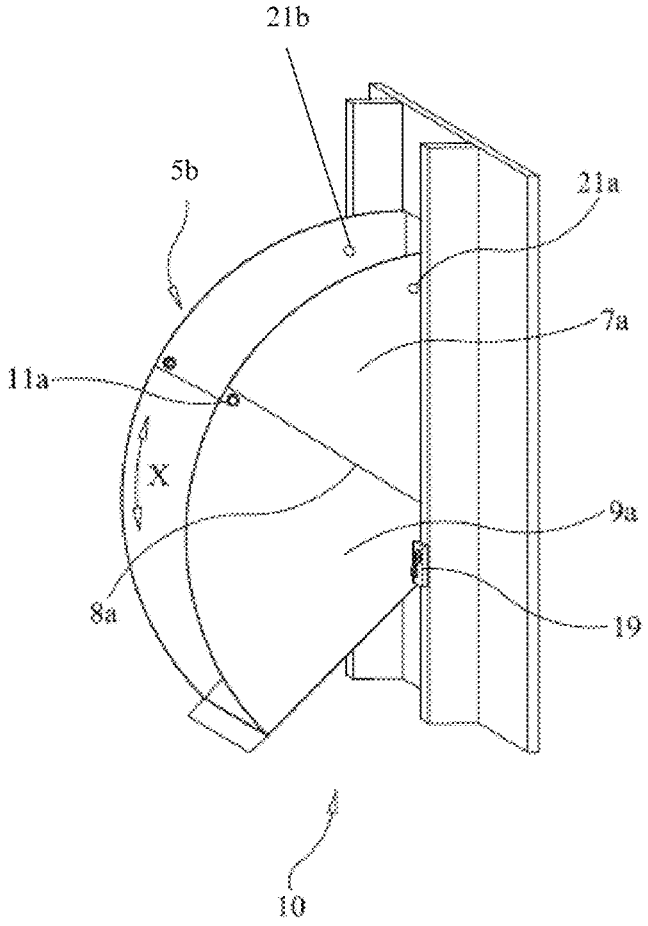
FIG. 3 is an inside angled and perspective view of the package receptacle chute in the open position relative to the package retrieval side.

Turning again to FIG. 2, each side panel, namely 5*a* and 5*b*, is formed at least by a first section, 7*a* and 7*b*, respectively, that is foldably connected to front panel 1, and a second section, 9*a* and 9*b*, respectively, that is foldably connected to the floor panel 3. The first and the second sections of side panels 5*a* and 5*b* are capable of being affixed to one another at interfaces 8*a* and 8*b*, respectively, by way of attachment means 11*a* and 11*b*, respectively, to render the resulting side panels 5*a* and 5*b* as a substantially planar and contiguous sidewall. It will be appreciated by the artisan of ordinary skill that the term contiguous or substantially contiguous, as used herein, shall not preclude any overlapping of sections 7*a* and 9*a* or sections 7*b* or 9*b* since a reasonable amount of overlap will be obviously necessary so as to affix the sections to one another using attachment means 11*a* and 11*b*, respectively. Additionally, ordinary artisan will further appreciate that the upper edges of side panels 5*a* and 5*b* may be preferably rounded so as to include a convex radial shape X as shown in FIG. 3 which imparts the maximum height to the side panels while still being sized to afford adequate clearance for movement of the chute between an open position for receiving packages and the closed position.

In the event that receptacle chute 10 is to be disposed within an aluminum garage door, for example, the exterior surface of front panel 1 that faces outside may preferably include that portion of the garage door that has been excised to create a portal in the door for positioning the chute. Once excised from the door, the cut-out aluminum panel may then be affixed to front panel 1 of chute 10. Importantly, the panel area to be excised must be selected so as to clear any horizontal and vertical supporting framework present and adjoined to the interior surface of the garage door as well as any garage door locking mechanisms. Additionally, front panel 1 may optionally include a lip to serve as a positional stop which can be included at the time of fabrication or as an add-on strip such as the edge protective stripping discussed below.

Most standard garage doors have similar dimensions and configurations for this framework, especially as between doors designed by the same manufacturer. Accordingly, it is contemplated that the chute of the present invention may be fabricated with variances in panel sizes to accommodate different garage doors or other vertical structures where the chute is to be installed so as to be compatible with the existing framework.

Figure 4:
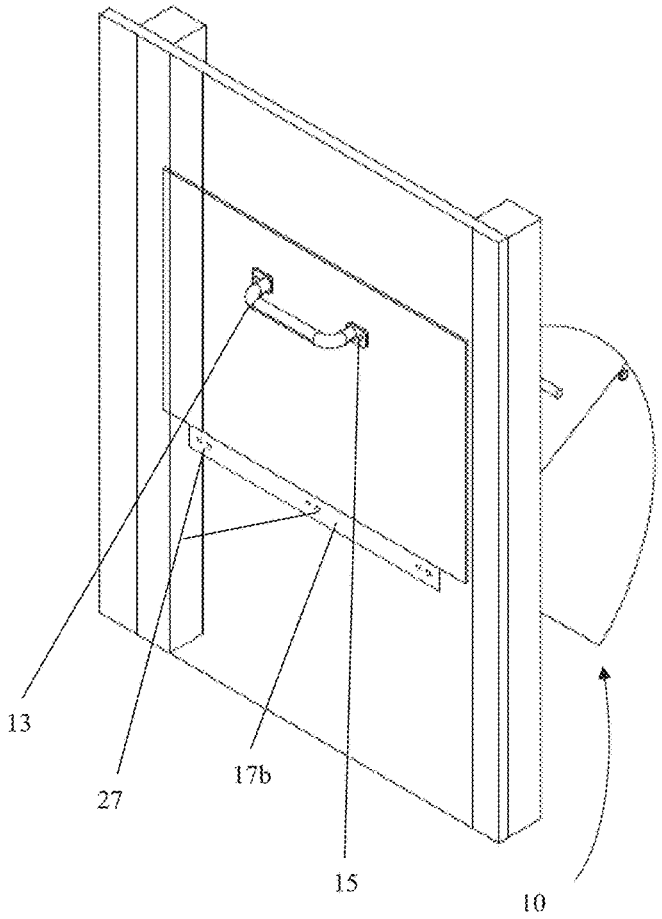
FIG. 4 is an outside elevated perspective view of the package receptacle chute in the closed position relative to the package delivery side.

Turning briefly to FIG. 4, front panel 1 may further comprise handle 13 attached thereto by any suitable handle attachment means 15, such as nuts and bolts. Also, the chute panels may be preferably trimmed with RF-KP aluminum channel stripping to cover any sharp edges and to further facilitate a flush closure against the garage door.

Figure 5:
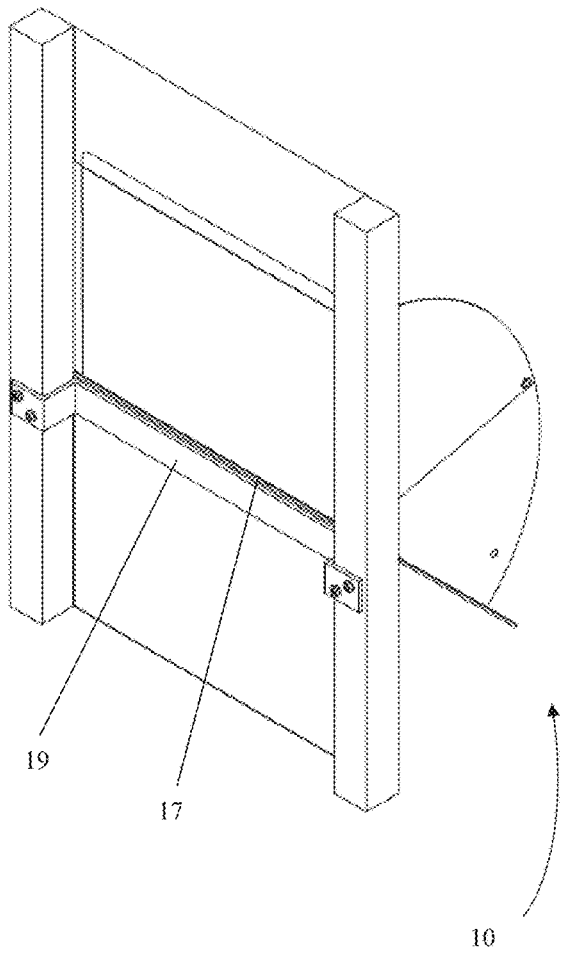
FIG. 5 is an inside elevated perspective view of the package receptacle chute in the closed position relative to the package retrieval side showing a stability bracket and a hinge.

Referring again to FIG. 2, sections 7*a* and 9*a* are affixed to one another at interface 8*a* by attachment means 11*a* (e.g. rivets or bolts) to form side panel 5*a* of chute 10. In one preferred embodiment, holes 21*a* and 21*b* (best shown in FIG. 3) drilled on the upper aspect of both sides of the receptacle chute are included to accommodate the horizontal bar locking mechanism/wind guard 23. Mechanism 23 prevents front panel 1 from opening during inclement weather, especially windy conditions, or when packages are not expected. Upper sections 7*a* and 7*b* and lower sections 9*a* and 9*b* are connected to one another by attachment means 11*a* and 11*b*, respectively, to form a parcel repository for chute 10. A steel or aluminum horizontal bracket 19 or similar bracketing or support means may be fabricated and employed to reinforce and further support the garage door near the excised area where the chute is positioned by way of attachment to the vertical support studs on the inside aspect of the garage door as shown in FIG. 5.

Chute 10 may be attached to a garage door or other vertical structure by any suitable hinged attachment means known to those of ordinary skill in the construction and fabrications arts. Such artisans will undoubtedly be quite familiar with and capable of easily constructing any number of designs for supporting and anchoring chute 10 within any vertical structure. One preferable attachment means includes at least one hinge having at least two hinge plates. Generally, the first hinge plate is affixed to the chute at either the front panel or the floor panel while the second hinge plate is affixed to the existing wall or door just below the aperture cut to house the chute. It will be obvious to those skilled in the art that if the hinge is to be attached to the front panel, the attachment point should be at its inferior edge which adjoins the floor panel to form the vertex of the obtuse angle.

Alternatively, if the hinge is to be attached to the floor panel, the attachment point should be at its leading edge of the floor panel near such vertex.

Additionally, it will be appreciated by the artisan that a variety of hinge types may be incorporated into the inventive design provided that they have suitable durability and strength for supporting the chute and any parcels as the chute pivots as well as having an adequate pivot arc between the hinge plates to allow the chute to pivot between the open position for receiving a parcel on one side of a wall or door and the closed position for delivering the parcel on the other side. One suitable hinge is commonly referred to as a piano hinge which typically has almost a full 360-degree pivot arc as between the hinge plates. Suitable hinges may, for example, be fashioned as a singular, elongated heavy duty hinge that runs substantially the width of the chute as exemplified by hinge 17 as partially shown in FIG. 5. Alternatively, multiple discrete hinges may be spaced, preferably equidistantly, along the width of the chute at the vertex of the obtuse angle within adequate proximity to either the floor or front panel to allow for one of the hinge plates to attach.

Turning to FIGS. 2 and 4, taken together, a hinged attachment means is shown as a unitary hinge 17 in articulation with hinge plates 17*a* and 17*b*. Attachment 25 (e.g. single rivets, equally spaced) is shown attaching floor panel 3 to hinge plate 17*a* while attachment 27 (e.g. three pairs of rivets, equally spaced) is shown attaching hinge plate 17*b* to an existing garage door just below the aperture cut to house the chute.

Optional bracket(s) 19 is preferably fashioned as a horizontal bracket as the one shown in FIG. 5. It will be appreciated by the ordinary artisan that the bracket should be preferably fabricated with suitable dimensions and in a suitable configuration for reinforcing and supporting the garage door near the excised area where the chute is positioned by way of attachment to the vertical support studs on the inside aspect of the garage door as shown in FIG. 2 taken together with FIG. 5. The bracket may be preferably fashioned from 16 Ga steel or standard aluminum other material of suitable strength and rigidity. Additionally, one or more vertical brackets may be included if needed or desired for added stability, especially where the horizontal bracket requires an attachment site otherwise not present in the existing garage door framework.

Referring again to FIG. 6, it will be appreciated by those skilled in the art that side panels 5*a* and 5*b* and floor panel 3 may be folded inward to lay flat against front panel 1 when package receptacle chute 10 is not in use and extra floor space is needed, as further explained below. This "fold away" feature is also advantageous when the chute of the present invention is mailed or shipped to a purchaser as an after-market add-on for a wall or door since it can be packaged and sent in a flat box that is more conducive to less expensive standard courier shipping rates. Moreover, the foldable nature of the panels allows the chute of the present invention to be more easily incorporated during the manufacturing and packaging of pre-fabricated walls and doors which are typically shipped in flat boxes where any protruding items such as a fully deployed chute would require additional packaging materials and expense to accommodate.

In its most basic embodiment, the receptacle chute of the present invention may include panels that all derive from a single sheet of heavy duty aluminum that can be pre-cut in a configuration that can be folded to form the sheet into a parcel repository. This feature affords significant shipping and packaging advantages as the chute may be shipped to vendors and end users at standard, flat parcel rates at a considerable cost savings. This type of foldable connection between the panels is typically achieved by providing standard relief cuts in the sheet metal and is quite well known in the art of metalworking.

Figure 6:
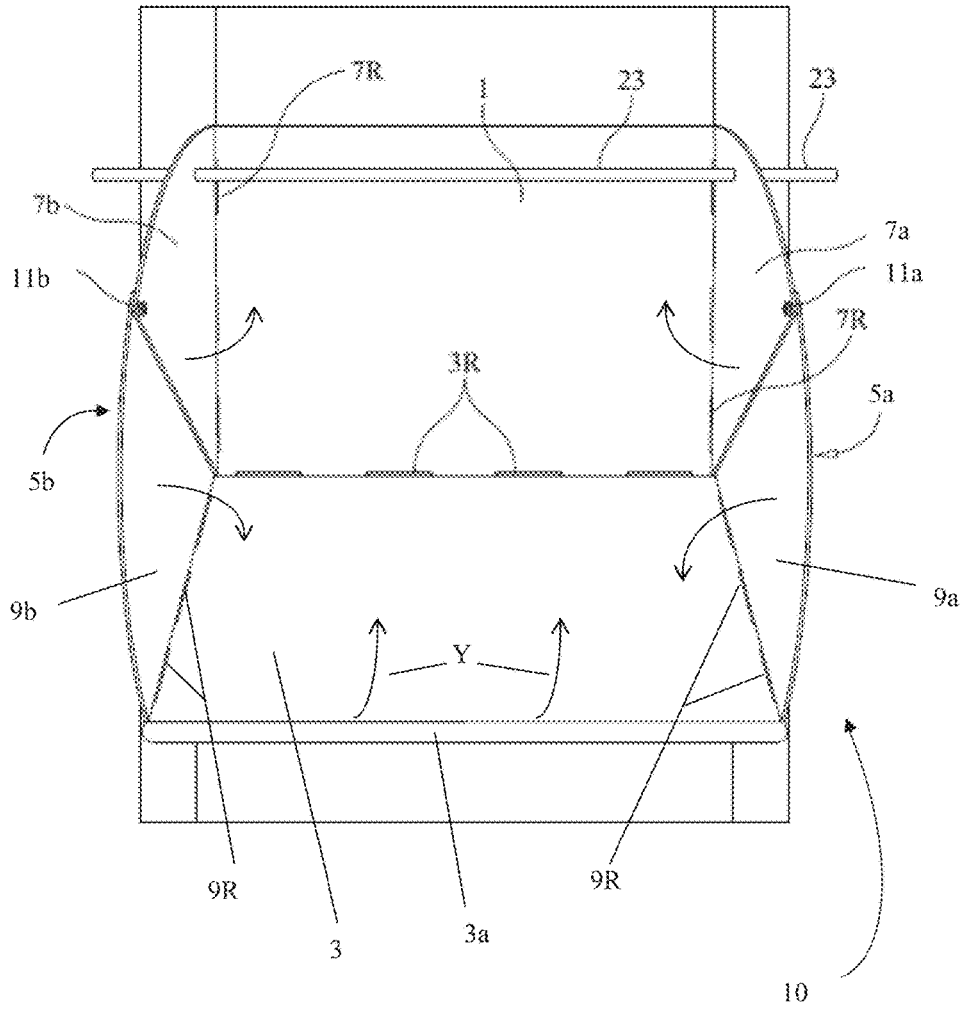
FIG. 6 is a full frontal inside view of the package receptacle chute in the open position relative to the package retrieval side.

For example, FIG. 6 shows relief cuts 7R which may be included to facilitate a foldable connection between section 7*a* and front panel 1 as well as section 7*b* and floor panel 3. Similarly, relief cuts 9R may be included to facilitate a foldable connection between section 9*a* and front panel 1 as well as section 9*b* and floor panel 3. Relief cuts 3R facilitate a foldable connection between floor panel 3 and front panel 1. Preferably, these foldable connections are fashioned using hinges or other suitable foldable articulations, especially when repeated configurational manipulations of the chute are contemplated to accommodate changes in the need for space in the proximity of the chute.

For example, garage areas typically become cluttered over time with various items such as tools, toys and sports equipment thereby rendering obstacles to foot traffic as well as impeding the accommodation of vehicles. In one preferred embodiment, the chute of the present invention is contemplated to fold up in a flattened, nonoperational configuration which can be stowed away in an upright orientation flat against the inside of a garage door or other vertical structure to provide additional clearance for passage in and around the area in proximity to the chute.

Accordingly, the foldable connection between the panels should be durable enough to undergo multiple and frequent configurational changes between the deployed, operational chute position and the flattened, nonoperational stored position. Various hinges and other foldable articulations are commercially available and suitable to serve as a foldable connection between the panels so long as they are suitable in size and shape to connect the panels and afford adequate folding for the panels to fold inward and flatten to assume a nonoperational, stored configuration and to be re-deployed to form the chute repository when desired.

Additionally, in the event that chute 10 is contemplated for frequent configurational changes between the deployed, operational chute position and the flattened, nonoperational stored position, it will be appreciated that attachment means 11*a* and 11*b* should be preferably selected so as to enable rapid removal during chute flattening and rapid re-attachment during chute deployment. Any number of suitable choices for such an attachment is well known in the art such as a bolt and wing-nut arrangement that can be readily installed and removed manually without the need for tools.

As an additional advantage, the receptacle chute can be folded and flattened to fit inside a flat box for ease in shipping, whether shipped as part of an existing structural assembly such as a garage door or as an after-market kit shipped to a homeowner for installment on site. The receptacle chute can then be opened to the designed size at its destination during assembly and installation.

In order to reconfigure receptacle chute 10 from a deployed, operational position to a flattened, nonoperational stored position, attachment means 11*a* and 11*b* must first be removed whereupon sections 7*a* and 7*b* may be folded inward along the directional arrows as shown to meet front panel 1 (see FIG. 6). Similarly, sections 9*a* and 9*b* may be folded inward along the directional arrows to meet floor panel 3 which may then be folded up and toward front panel 1 along directional arrows Y to render chute 10 in the flattened position. Turning briefly to FIG. 2, locking bar may be passed through retainer means 29*a* and 29*b* and across the flattened assembly to retain it upright when the chute is in the nonoperational, stored position.

Where the present invention is to be utilized with a garage door, for example, the receptacle chute may preferably undergo fabrication by garage door manufacturers. The process begins with the manufacturer removing/excising a section or panel from the garage door. The section or panel may later serve as an external face plate to affix to the front door/lid of the receptacle chute thereby maintaining aesthetic continuity with the external aspect of the garage door, or any wall or door for that matter.

It can be seen from the drawings that a four-sided receptacle chute having a front panel, a bottom or floor panel and two side panels is created, wherein front panel 1 and floor panel 3 are connected at an obtuse angle (i.e., greater than 90, but less than 180 degrees) in relation to one another and are subsequently adjoined to side panels 5*a* and 5*b*. In one preferred embodiment, the secure package receptacle chute of the invention is pre-fabricated by the garage door manufacturer from an appropriate sized, flat sheet of aluminum or other suitable material with the relief cuts discussed above.

As mentioned, the cut-out panel of the garage door may be affixed to the front of the chute before the handle is attached. Metal strips (edging) on the top and sides of the front panel should be adhered to the door/lid by the manufacturers. The metal trim strips will fit flush against the rest of the panel section of the garage door.

The receptacle chute of the present invention may also optionally include a locking means disposed on the internal aspect of the chute to prevent the chute from being opened. For example, the locking means may be a horizontal steel locking bar that is slidably received through both side panels and having a length greater than the width of the chute to engage the structure in which the chute resides thereby preventing the chute from movement. The bar is inserted into and across the front of the top aspect of the side panels through holes 21*a* and 21*b* to engage the vertical bracket frames on the back (inside) of the garage door as shown in FIG. 6. The locking bar will impede the receptacle door/lid from opening during inclement weather invasion such as wind gusts and downward drafts and will keep the receptacle door/bin closed during those periods when packages are not expected. Additionally, locking bar 23 may also be used to maintain the chute in a nonoperational, flattened position as described above.

Although the exemplary chute panels discussed above are preferably fabricated from aluminum, other appropriate materials such as plastic or fiberglass may also be used provided it has suitable strength and rigidity. It will be appreciated by those of ordinary skill in the manufacturing and fabrication arts that the invention is not limited to size and the production of same should include the necessary brackets piano hinge, nuts, bolts, rivets, metal strips, locking bar and handle. Additionally, the artisan will further appreciate that the manufacturing discussion set forth above is generalized for making the receptacle chute of the present invention for disposition within a garage door and that the foregoing procedure may be readily adapted to make the receptacle chute for disposition within most walls and doors.

The present invention also provides for a kit for installing a package receptacle chute within a wall or door. The kit includes a chute having a front panel that is foldably connected to and extends from a floor panel at an obtuse angle. The front panel and floor panel are further connected to one another by two opposing side panels. The panels are configured to form a pivoting package repository for securely receiving and transferring a package from one side of a wall or door to the other side. Each side panel includes at least two independent sections. The first section is foldably connected to the front panel while the second section is foldably connected to the floor panel. Additionally, the first and the second sections are affixed to one another to render the resulting side panel substantially planar and contiguous.

The kit also includes at least one hinged attachment means for attaching the chute to the wall or door, preferably at least one hinge articulating with at least two hinge plates. The first hinge plate is affixed to the chute at either the front panel or the floor panel while the second hinge plate is affixed to the existing wall or door.

The present invention also provides a method for installing a package receptacle chute within a wall or door. The method includes providing a chute having a front panel, a floor panel and two side panels. The front panel is connected to the floor panel and the front panel and floor panel are then further connected to one another by fashioning two opposing side panels. The panels are configured to form a pivoting package repository for securely receiving and transferring a package from one side of a wall or door to the other side. The sides are created by connecting a first top section to a second bottom section foldably connected to the floor panel. The first and the second sections capable of being affixed to one another to render the resulting side panel substantially planar and contiguous.

The method further calls for providing at least one hinged attachment means for hingedly attaching the chute to a vertical structure such as the wall or door. Before the chute can be mounted in the wall or door, a section of the structure approximating the dimensions of the chute must be removed or cut out of the structure to accommodate the chute. This cutaway section may then be optionally affixed to the front panel to provide an external face plate.

Once the chute is assembled, it is mounted within the wall or door by way of a mounting assembly that should include, at a minimum, at least one hinged attachment means for hingedly attaching the chute to a vertical structure such as the wall or door. For example, the hinged attachment means may include at least one hinge that articulates with two hinge plates. The first hinge plate is affixed to the chute at either the front panel or the floor panel while the second hinge plate is affixed to the existing wall or door.

The invention 10, allows for the delivery person to easily access the secured package receptacle chute and place package (s) in the downward angled chute compartment thus allowing the package(s) to fall on a soft cushioned surface on the garage floor, out of sight and secure inside the garage.

With respect to the above description, it is to be realized that the optimum dimensional relationships for the parts of the secure package receptacle chute to include variations in size, materials, shape, form, function and the manner of operation, assembly and use, all of which are deemed readily apparent and obvious to one skilled in the art, and all equivalent relationships of those embodiments illustrated in the drawings and described in the specification are intended to be encompassed by the present invention. Directional terms such as “front”, “sides”, “floor”, “upper”, “lower” and the like, may have been used in the description. These terms are applicable to the examples shown and described in conjunction with the drawings.

While the invention has been described in its preferred forms or embodiments with some degree of particularity, it is understood that the detailed description as set forth herein has been provided only by way of example and that numerous modifications, changes, variations, substitutions and equivalents may be available as well as alternative details regarding construction, fabrication, and use, including the combination and arrangement of parts, all of the foregoing being readily apparent to those skilled in the art without departing from the spirit and scope of the present invention as described and claimed.

We claim:

1. A unitary package receptacle chute for disposition within a wall or door, the chute comprising:

a front panel foldably connected to and extending at an obtuse angle from a floor panel, the front panel and floor panel further connected to one another by two opposing side panels, the panels being configured to form a pivoting package repository for receiving and transferring a package from one side of the wall or door to the other side, wherein each side panel comprises at least two independent sections, the first of such sections being foldably connected to the front panel and the second of such sections being foldably connected to the floor panel, the first and the second sections being affixed to one another to render the resulting side panel substantially planar and contiguous.

2. The package receptacle chute of claim 1 further comprising at least one hinged attachment means for hingedly attaching the chute to the wall or door.

3. The package receptacle chute of claim 2 wherein the chute is disposed within a garage door.

4. The package receptacle chute of claim 3 wherein the attachment means comprises at least one hinge articulating with at least two hinge plates.

5. The package receptacle chute of claim 1 wherein the front panel includes a face plate.

6. The package receptacle chute of claim 1 wherein the front panel includes a handle to open the chute.

7. The package receptacle chute of claim 1 wherein the obtuse angle is greater than 100 degrees.

8. The package receptacle chute of claim 1 wherein the obtuse angle is at least 100 degrees.

9. The package receptacle chute of claim 1 wherein the obtuse angle is at least 120 degrees.

10. The package receptacle chute of claim 1 further comprising a locking means for locking the chute, thereby preventing it from being opened.

11. The package receptacle chute of claim 10 wherein the locking means is comprised of a horizontal locking bar that is slidably received through both side panels, the bar having a length greater than the width of the chute suitable for engaging the structure in which the chute resides to prevent movement.

12. The package receptacle chute of claim 1 wherein the upper edges of the side panels are rounded in a convex radial shape.

13. A kit for installing a package receptacle chute within a wall or door, the kit comprising:

a front panel foldably connected to and extending at an obtuse angle from a floor panel, the front panel and floor panel further connected to one another by two opposing side panels, the panels being configured to form a pivoting package repository for receiving and transferring a package from one side of the wall or door to the other side, wherein each side panel comprises at least two independent sections, the first of such sections being foldably connected to the front panel and the second of such sections being foldably connected to the floor panel, the first and the second sections being affixed to one another to render the resulting side panel substantially planar and contiguous; and at least one hinged attachment means for hingedly attaching the chute to the wall or door.

14. The kit of claim 13 wherein the hinged attachment means comprises at least one hinge articulating with at least two hinge plates.

15. A method for installing a package receptacle chute within a wall or door, the method comprising:

providing a chute having a front panel foldably connected to and extending at an obtuse angle from a floor panel, the front panel and floor panel further connected to one another by two opposing side panels, the panels being configured to form a pivoting package repository for receiving and transferring a package wherein each side panel comprises at least two independent sections, the first of such sections being foldably connected to the front panel and the second of such sections being foldably connected to the floor panel, the first and the second sections being affixed to one another to render the resulting side panel substantially planar and contiguous;

providing at least one hinged attachment means for hingedly attaching the chute to the wall or door;

removing a section of the door or wall to accommodate the dimensions of the chute;

optionally attaching the removed section of the door or wall to the front panel of the chute; and attaching the hinged attachment means to the chute and to the wall or door.

* * * * *